US006099682A

United States Patent [19]

Krampe et al.

[11] Patent Number: 6,099,682

[45] Date of Patent: Aug. 8, 2000

[54] COLD SEAL PACKAGE AND METHOD FOR MAKING THE SAME

[75] Inventors: Stephen E. Krampe, Maplewood; Michael D. Delmore, Moundsview, both of Minn.

[73] Assignee: 3M Innovative Properties Company Corporation of Delaware, St. Paul, Minn.

[21] Appl. No.: 09/021,049

[22] Filed: Feb. 9, 1998

[51] Int. Cl.[7] ..... B32B 31/12; B65D 75/58

[52] U.S. Cl. ..... 156/289; 156/272.6; 156/277; 53/396; 53/425; 53/476

[58] Field of Search ..... 156/272.6, 277, 156/289, 291, 306.3; 53/396, 425, 473, 476; 206/439, 440, 363; 428/40.1, 195

[56] References Cited

U.S. PATENT DOCUMENTS

| | | |
|---|---|---|
| Re. 35,285 | 6/1996 | Quacquarella et al. . |
| 2,632,921 | 3/1953 | Kreidl . |
| 2,683,394 | 7/1954 | Polanyi et al. . |
| 2,684,097 | 7/1954 | Treul . |
| 2,704,382 | 3/1955 | Kreidl . |
| 2,746,084 | 3/1956 | Kreidl . |
| 3,503,859 | 3/1970 | Goncarovs et al. . |
| 3,546,065 | 12/1970 | Ostermeier . |
| 3,705,844 | 12/1972 | Haas . |
| 3,754,117 | 8/1973 | Walter . |
| 3,773,248 | 11/1973 | Cecil et al. . |
| 3,814,235 | 6/1974 | Glaze, Jr. . |
| 3,912,154 | 10/1975 | Godar . |
| 3,938,659 | 2/1976 | Wardwell . |
| 3,991,881 | 11/1976 | Augurt . |
| 4,091,195 | 5/1978 | Vitek . |
| 4,120,445 | 10/1978 | Carrier et al. . |

(List continued on next page.)

FOREIGN PATENT DOCUMENTS

| | | |
|---|---|---|
| 0 531 618 | 3/1993 | European Pat. Off. . |
| 555 830 A1 | 8/1993 | European Pat. Off. . |
| 0750887 | 1/1997 | European Pat. Off. . |
| WO 92/19508 | 11/1992 | WIPO . |
| WO 94/21742 | 9/1994 | WIPO . |
| WO 95/09876 | 4/1995 | WIPO . |
| 97/25200 | 7/1997 | WIPO . |
| WO 98/00471 | 1/1998 | WIPO . |

OTHER PUBLICATIONS

"Hot–melt cold–seal adhesives", *Food & Drug Packing,* p. 13, Aug. 1998.

H. Weiss, *Rotogravure and Flexographic Printing Presses,* p. 165, Converting Technology Corp. (Milwaukee, WI), 1985.

*Modern Coating and Drying Technology;* E. Cohen et al., Eds.; VCH Publishers: New York; pp. 79–108; 1992.

John Merritt (Business Director for Coated Products at Rexam Medical Packaging), *Press Release from Rexam Medical Packaging,* 2 pages (Undated).

*Primary Examiner*—Curtis Mayes
*Attorney, Agent, or Firm*—Stephen W. Bauer

[57] ABSTRACT

The present invention is directed to a cold seal package that includes constructions wherein two substrates, or two portions of one substrate, are sealingly engaged to one another using a substantially natural latex rubber-free contact adhesive. The two substrates can be easily peeled apart without substantial damage to the substrates. Furthermore, the substrates cannot typically be resealed, or refastened, once peeled apart. That is, the cold seal formed by the adhesive between the substrates is substantially non-refastenable. Advantageously, a cold seal package of the present invention is particularly well suited for aseptic delivery of packaged goods, such as bandages, dressings, and the like.

28 Claims, 2 Drawing Sheets

U.S. PATENT DOCUMENTS 4,209,091 6/1980 Lieberman .
4,234,662 11/1980 Pastor et al. .
4,442,259 4/1984 Isgur et al. .
4,457,430 7/1984 Darling et al. .
4,488,646 12/1984 McCorkle .
4,521,467 6/1985 Berger ..... 428/35
4,637,411 1/1987 Sanders .
4,686,324 8/1987 Debaisieux et al. .
4,781,293 11/1988 Johns .
4,804,573 2/1989 McCarthy et al. .
4,810,745 3/1989 Pike et al. .
4,810,747 3/1989 Bornack, Jr. et al. .
4,859,521 8/1989 Pike et al. .
4,877,674 10/1989 Kappes .
4,881,649 11/1989 Hsu et al. .
4,889,884 12/1989 Dust et al. .
4,898,787 2/1990 Min et al. .
4,902,370 2/1990 Dust et al. .
4,915,228 4/1990 Johns .
4,930,646 6/1990 Emslander .
4,931,327 6/1990 Liu et al. .
4,944,409 7/1990 Busche et al. .
4,960,637 10/1990 Biczenczuk .
4,975,481 12/1990 Tamm et al. .
4,977,003 12/1990 Brown et al. .
5,001,888 3/1991 Groth .
5,039,652 8/1991 Doll et al. .
5,070,164 12/1991 Min et al. .
5,091,240 2/1992 Kajander et al. .
5,145,929 9/1992 Ou-Yang .
5,174,846 12/1992 Bate et al. .
5,180,599 1/1993 Feldmeier et al. .
5,184,771 2/1993 Jud et al. .
5,190,997 3/1993 Lindemann et al. .
5,194,299 3/1993 Fry .
5,215,249 6/1993 Gorrieri .
5,259,503 11/1993 Steingraber, Jr. .
5,270,088 12/1993 Grasse .
5,356,975 10/1994 Bening et al. .
5,360,116 11/1994 Schmiletzky .
5,397,297 3/1995 Hunter .
5,443,915 8/1995 Wilkie et al. .
5,460,838 10/1995 Wermund .
5,466,734 11/1995 Catena et al. .
5,482,780 1/1996 Wilkie et al. .
5,486,426 1/1996 McGee et al. .
5,489,473 2/1996 Wilkie et al. .
5,494,726 2/1996 Inomata .
5,510,124 4/1996 Kopecky et al. .
5,516,583 5/1996 Zhang et al. .
5,516,865 5/1996 Urquiola .
5,518,169 5/1996 Beales .
5,567,773 10/1996 McGee et al. .
5,616,400 4/1997 Zhang .
5,622,028 4/1997 Harp .
5,662,265 9/1997 Jensen .
5,664,675 9/1997 Weder .
5,691,052 11/1997 Jones .
5,711,418 1/1998 Jordan .
5,735,454 4/1998 Jensen .
5,741,840 4/1998 Lindquist et al. .

COLD SEAL PACKAGE AND METHOD FOR MAKING THE SAME

BACKGROUND OF THE INVENTION

Cold seal packages have openings that are sealed under the application of pressure without the need for the application of elevated temperatures. Cold seal packaging can be used to package a variety of goods, including comestibles, pharmaceuticals, and medical supplies. They typically utilize cold seal adhesives such as natural rubber (also referred to as latex rubber). Such cold seal adhesives are differentiated from heat seal adhesives in that heat seal adhesives typically require both elevated temperature and pressure for activation. Cold seal adhesives are used as an alternative in packaging because heat seal adhesives have limitations in manufacturing. For example, heat seal adhesives require additional time for thermal diffusion to activate them.

Natural rubber (or latex rubber) has several disadvantages. Of particular concern is that it can initiate an allergic response in people. It is believed that certain people become sensitized to allergens in natural rubber over repeated exposure to natural rubber and, thus, exhibit increasingly severe allergic responses upon each exposure. This is particularly significant in the medical area where both health care workers and chronically ill patients are repeatedly and directly exposed to products, such as natural rubber gloves, tubing, and the like. To a lesser extent, medical packaging for wound dressings and bandages may also contain natural rubber in the cold seal adhesives used in packaging. Other disadvantages of natural rubber include discoloration upon aging and an unpleasant odor.

Synthetic cold seal adhesives have been incorporated into packaging to overcome the disadvantages associated with natural rubber. For example, U.S. Pat. No. 4,442,259 (Isgur et al.) describes the use of aqueous based polyurethanes in cold seal packaging applications. U.S. Pat. No. 5,616,400 (Zhang) describes a cold seal adhesive for use in forming packages. The cold seal adhesive is formed from a polyurethane ionomer, wherein overlapping coatings of the cold seal adhesive are pressed together forming an envelope enclosing an item packaged. That is, the seal is formed between the same substrates and same adhesives with no difference in adhesion at the two interfaces between the layer of adhesive and the substrates.

While these patents have described the adhesive characteristics of these synthetic cold seal materials, the opening characteristics of packaging remain an important consideration. This is of particular concern in packaging pharmaceutical and medical supplies to maintain sterility within the package. Evidence of tampering or breach of the cold seal are important features of such packaging. However, a competing interest is also opening the bond formed in a package with a cold seal material. For example, it is desirable that the package be easily opened with controlled predictable motion and force resulting in a decreased likelihood of spillage of the package contents.

Thus, what is yet needed is a cold seal package which exhibits sufficient bond strength and yet is easily opened and preferably provides evidence of prior opening.

SUMMARY OF THE INVENTION

Methods for making a cold seal package and cold seal packages are provided by the present invention. A cold seal package generally includes constructions wherein two substrates, which can be two discrete portions of a contiguous sheet material, for example, are sealingly engaged to one another, preferably, to form a sealed enclosure for placement of an article therein. The two sealing portions of the substrate(s) can be generally easily and cleanly peeled apart without substantial damage to the substrate(s). Furthermore, the sealing portions of the substrate(s) cannot typically be resealed, or refastened, once peeled apart, thereby forming a substantially "non-refastenable cold seal." By this it is meant that after initially sealing, opening, and then again engaging the sealing portions of the substrate(s), a very small or nonexistent force would be required for reopening the package.

This non-refastenable cold seal can be formed, for example, between two sealing portions of the substrate(s) and two layers of contact adhesive, which may be the same or different. The bond formed at the interface of the two layers of contact adhesive is typically a substantially permanent bond (referred to herein as a cold seal bond or a cold seal adhesive bond). That is, upon opening the package of the present invention at the cold seal, the layers of adhesive are not separated from each other. The bond formed at the interface of a layer of the contact adhesive and one of the substrates (i.e., the anchor substrate) is also typically a permanent bond, whereas the bond formed at the interface of a layer of the contact adhesive and the other substrate (i.e., the transfer substrate) is a peelable and nonrefastenable bond. The bond at the interface of the layer of the contact adhesive and the transfer substrate is peelable as a result of a layer of a release coating on the surface of the transfer substrate. The peelability may result from release of the adhesive and the release coating from the transfer substrate, or portions thereof, or from release of just the adhesive with the release coating remaining on the transfer substrate.

In one embodiment, the present invention provides a method for making a cold seal package comprising the steps of: applying a first substantially natural latex rubber-free contact adhesive to an anchor surface to form an anchor contact adhesive coating; applying a release coating composition to a transfer surface to form a release-coated transfer surface; applying a second substantially natural latex rubber-free contact adhesive to the release-coated transfer surface to form a transfer contact adhesive coating; and contacting the anchor contact adhesive coating with the transfer contact adhesive coating, each of which are at a temperature of about 50° C. or less, to form a substantially non-refastenable cold seal between the anchor surface and the release-coated transfer surface; wherein, upon peeling the anchor and transfer surfaces apart, substantially all of the anchor contact adhesive coating and the transfer contact adhesive coating that formed the cold seal remain on the anchor surface. It will be understood that there may be other portions of the transfer contact adhesive that were not used in forming the cold seal that remain on the transfer substrate depending on the coating patterns of the contact adhesive layers and release coating.

The first substantially natural latex rubber-free contact adhesive and the second substantially natural latex rubber-free contact adhesive may be the same contact adhesive or they may be different contact adhesives. Preferably, the contact adhesives have an open time of at least about 24 hours at a temperature of about 50° C. or less. The first and second substantially natural latex rubber-free contact adhesives preferably each comprise a material selected from the group of a polychloroprene, a polyurethane, a styrene-isoprene copolymer, a styrene-butadiene copolymer, a polyimide, a polyvinyl chloride, a nitrocellulose, a polyisoprene, an acrylonitrile-butadiene-isoprene terpolymer, a butadiene-methacrylonitrile copolymer, a polyethylene-vinyl acetate copolymer, a polyacrylate, and mixtures thereof. Preferably, at least one of the first and second substantially natural latex rubber-free contact adhesives is formed from an aqueous polyurethane dispersion.

Preferably and advantageously for enhanced adhesion of the contact adhesive, the anchor surface is treated prior to applying the first substantially natural latex rubber-free contact adhesive. This step of treating the anchor surface preferably involves corona treating the anchor surface, although other treatment techniques can be used, such as flame treatment or coating with a primer, for example.

Upon applying the release coating composition to a transfer surface, preferably and advantageously, a substantially continuous release coating is formed. By this it is meant that the release coating includes few, if any, voids, for example. This substantially continuous release coating can be pattern coated or flood coated on the transfer surface, preferably, however, it is pattern coated. The release coating composition preferably comprises a release material selected from the group of an ethyl acrylate-acrylonitrile copolymer, an acrylic acid-alkyl acrylate copolymer, a polyvinyl chloride resin, a polyvinyl N-octadecyl carbamate, a polyethylene based wax, a polyamide based wax, a polysiloxane, a fluorocarbon polymer, a polyvinyl ester, a polyethylene imine, an alkyl substituted amine, a chromium complex, a fatty acid based wax, and mixtures thereof. The release coating composition can optionally also include a substantially natural latex rubber-free contact adhesive.

In certain embodiments of the method, the anchor surface and the transfer surface are on two separate substrates, as for example, when each comprises a first major surface of separate sheet materials. In other embodiments, however, the anchor surface and the transfer surface are on two different portions of the same substrate, as for example, a contiguous sheet material. When both surfaces are part of a contiguous sheet material, the anchor surface and the transfer surface may each be on a different portion of a first major surface of the sheet material. Alternatively, the anchor surface may be on a portion of a first major surface of the sheet material and the transfer surface may be on a second major surface of the sheet material.

Typically, in forming a package, the step of contacting the adhesive coatings to form a substantially non-refastenable cold seal produces an enclosure within the package. An article, preferably, a medical product such as a bandage, for example, is placed in the enclosure before completely sealing the package. Typically, when a medical product is placed inside the package, after sealing the package, the method includes a step of sterilizing the medical product. The method of the invention can also optionally include a step of printing graphic indicia on a substrate, such as on one of the separate sheet materials.

The present invention also provides a cold seal package comprising: an anchor substrate having a first major surface and a second major surface; a transfer substrate having a first major surface and a second major surface, wherein the first major surface of the transfer substrate has a release coating thereon to form a release-coated surface; and a substantially natural latex rubber-free contact adhesive disposed between the first major surface of the anchor substrate and the release coating of the release-coated surface of the transfer substrate forming a substantially non-refastenable cold seal between the anchor substrate and the transfer substrate; wherein adhesion between the contact adhesive and the first major surface of the anchor substrate is greater than adhesion between the contact adhesive and the release-coated transfer substrate. Preferably, substantially all of the substantially natural latex rubber-free contact adhesive remains on the first major surface of the anchor substrate upon opening a cold seal package by peeling the anchor substrate and transfer substrate apart. More preferably, at least a portion of the substantially continuous release coating also remains on the substantially natural latex rubber-free contact adhesive upon opening a cold seal package by peeling the anchor substrate and transfer substrate apart. Preferably, a cold seal package has a T-Peel Force between the release-coated transfer substrate and the substantially natural latex rubber-free contact adhesive of about 600 g/2.5 cm or less.

Preferably, in the package the anchor substrate and the transfer substrate each comprise a sheet material. Alternatively, the anchor substrate and the transfer substrate form different portions of the same substrate, such as a contiguous sheet material.

The anchor substrate and the transfer substrate can each have the same or a different substantially natural latex rubber-free contact adhesive coated thereon. Preferably, the substantially natural latex rubber-free contact adhesive can include two layers of different contact adhesives, one coated on each of the anchor substrate and the transfer substrate at a coating weight of about 4.0 g/m$^2$ or less. Each can be pattern coated or flood coated, preferably, however, the contact adhesive layer adjacent the release coating is substantially contiguous with the transfer substrate. In this case, the substantially continuous release coating is pattern coated on the transfer substrate.

Another embodiment of the present invention is a cold seal package comprising: an anchor substrate having a first major surface and a second major surface; a transfer substrate having a first major surface and a second major surface, wherein the first major surface has a substantially continuous release coating thereon to form a release-coated surface; and a substantially natural latex rubber-free contact adhesive having an open time of at least about 24 hours disposed between the first major surface of the anchor substrate and the release-coated surface of the transfer substrate, wherein a substantially non-refastenable cold seal is formed between the first major surface of the anchor substrate and the release coating of the release-coated surface of the transfer substrate such that adhesion between the contact adhesive and the first major surface of the anchor substrate is greater than adhesion between the contact adhesive and the release-coated transfer substrate.

As used herein, "non-refastenable cold seal" means a seal formed between two substrates, which can be two portions of the same substrate such as two different portions of a contiguous sheet material, using an adhesive or combination of adhesives that can form a bond at room temperature (i.e., about 20° C. to about 30° C.). The peel strength of the non-refastenable cold seal of a package of the present invention is at least about 20 grams/2.5 centimeters (20 g/2.5 cm). Preferably, the non-refastenable cold seal has a peel strength of at least about 80 g/2.5 cm and is stable (i.e., the seal does not fail) at temperatures typically encountered during transportation and delivery, which can be up to about 70° C. This non-refastenable cold seal includes bonds formed at a number of interfaces, e.g., between an adhesive and an anchor substrate (typically, a permanent bond), between two layers of adhesive (typically, a permanent "cold seal bond"), between a release coating and a transfer substrate (optionally, a peelable bond), and between an adhesive and a release coating (optionally, a peelable bond).

As used herein, "natural latex rubber" or "natural rubber" means a milky fluid primarily obtained from the *Heavea*

*brasiliensis* tree (also know as the rubber tree). Typically, the milky fluid contains small particles of naturally occurring substances, such as cis-1,4-polyisoprene, stabilized by proteins and dispersed in an aqueous medium.

As used herein, "substantially natural latex rubber-free" refers to a contact adhesive composition to which natural rubber is not intentionally added. Preferably, the contact adhesive composition contains about 1 part per million (ppm) or less, and more preferably about 1 part per billion (ppb) or less, of a natural latex rubber and displays characteristics of a contact adhesive, as defined below.

As used herein, "contact adhesive" (also known as a cold seal adhesive) is one that preferentially adheres to itself or a chemically similar material under pressure or force without the need for significantly elevated temperatures (e.g., without the need for temperatures above 50° C.). Unlike pressure sensitive adhesives, contact adhesives are typically nonadhering or only very slightly adhering to chemically dissimilar surfaces at temperatures of about 15° C. to about 50° C. Thus, a contact adhesive preferably does not generally block, reseal, or stick to the contents placed inside the package. When placed against each other, contact adhesives typically require moderate pressure (such as that exerted by fingertip pressure) to achieve a bond without the application of significantly elevated temperatures. That is, packages may be sealed at room temperature (i.e., about 20° C. to about 30° C.) and even lower (e.g., 15° C.), as well as at temperatures of up to about 50° C., if the packaged product is not sensitive to such temperatures. The use of thermal curing or crosslinking agents in a contact adhesive are typically unnecessary to form a bond as is required in the formation of a "heat seal." Heat seal adhesives typically require the application of high temperatures, generally at least about 100° C., and often in a range of about 138° C. to about 205° C., in order to form a seal when the substrates are brought together. Thus, a contact adhesive (i.e., cold seal adhesive) as used herein is one that does not require elevated temperatures (i.e., above about 50° C.) for activation of its adhesive characteristics. This includes, however, contact adhesives that can be hot melt coated, but that do not require the application of heat to form a seal.

Indeed, some suitable contact adhesives may be hot melt coated. When the contact adhesive is hot melt coated, it is tacky in the molten state (e.g., at a temperature of about 90° C. to about 150° C.) but is nonadhering or very slightly adhering to chemically dissimilar surfaces at a temperature of about 50° C. or less, preferably at room temperature. Once the hot melt coated adhesive is cooled, a package is typically formed by bringing two adhesive-coated surfaces, which can be on two separate substrates or on the same substrate, together under moderate pressure, preferably at room temperature.

A contact adhesive is to be distinguished from a pressure sensitive adhesive (PSA). A PSA is typically tacky at room temperature, requires moderate pressure to achieve a bond (such as that exerted by fingertip pressure), but which adheres to a wide variety of dissimilar substrates. A pressure sensitive adhesive is conventionally understood to refer to an adhesive that displays permanent and aggressive tackiness to a wide variety of substrates after applying only light pressure. An accepted quantitative description of a pressure sensitive adhesive is given by the Dahlquist criterion line, which indicates that materials having a storage modulus (G') of less than about $3\times10^5$ Pascals (measured at 10 radians/second at room temperature, about 20° C. to about 22° C.) have pressure sensitive adhesive properties while materials having a G' in excess of this value do not.

DESCRIPTION OF THE PREFERRED EMBODIMENTS

A cold seal package in accordance with the invention generally includes two substrates or substrate surfaces, which can be two portions of one substrate such as two distinct portions of a contiguous sheet material, sealed together with a substantially natural latex rubber-free contact adhesive (i.e., a cold seal adhesive), including a mixture of adhesives, thereby forming a cold seal. Preferably, the two substrates and the seal form an enclosure for a product. The two sealed surfaces of the substrate(s) can be generally easily and cleanly peeled apart without substantial damage to the substrate(s) for removal of the product from the enclosure. Furthermore, the sealing portions of the substrate (s) cannot typically be resealed, or refastened, once peeled apart. Surprisingly, the cold seal is formed with a release coating as part of the sealed portion of the package. That is, a release coating is disposed between a portion of one substrate and the contact adhesive. Typically, such release coatings are used on the back side of a substrate coated with a contact adhesive to prevent blocking when the substrate is stored in a roll form. As a result of the release coating being part of the sealed portion (i.e., the cold seal) of the package, it can be opened by peeling apart the sealed surfaces of the substrate(s) without breaching the integrity of the substrate (s).

Figure 1:
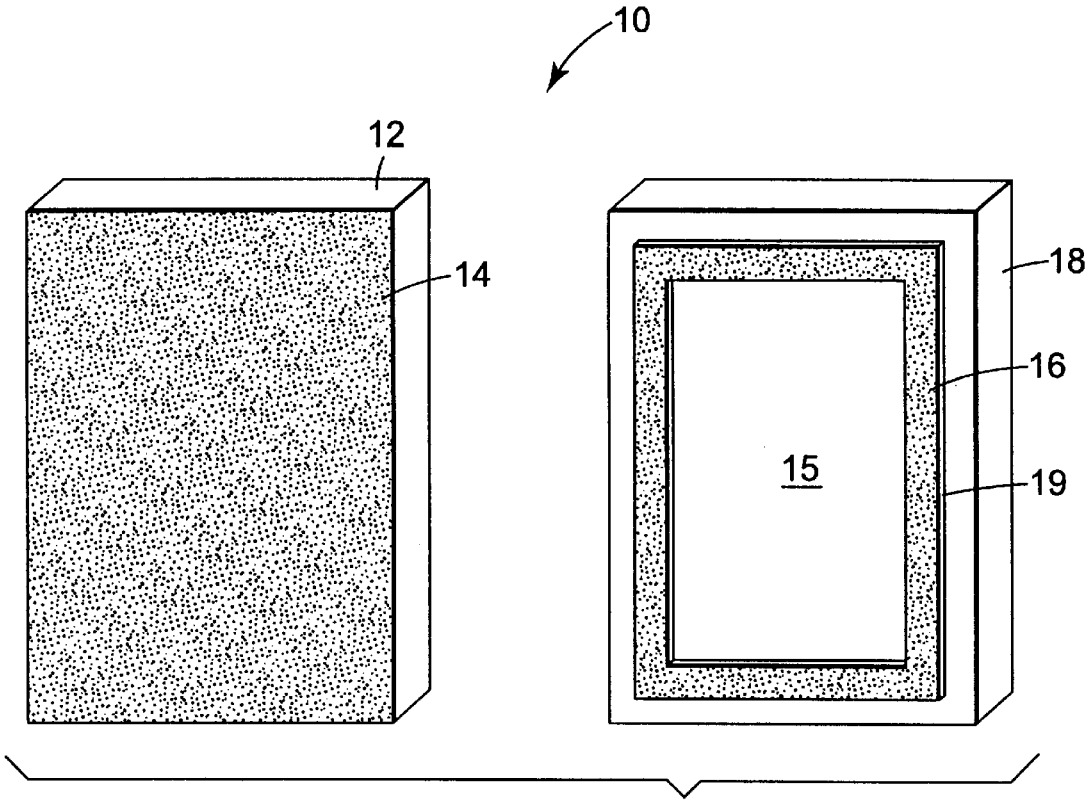
FIG. 1 is an exploded view of an unassembled cold seal package in accordance with the invention.

Referring to FIG. 1, a schematic view of one embodiment of an unassembled cold seal package 10 in accordance with the invention is shown. In one preferred embodiment, a cold seal package 10 includes a first substrate 12, also referred herein to as an "anchor substrate," in the form of a sheet material. Coated thereon is a first substantially natural latex rubber-free contact adhesive 14 (also referred to herein as "anchor coating contact adhesive"). The first substantially natural latex rubber-free contact adhesive 14 can be coated in any desired pattern on the anchor substrate, including the entire surface of the substrate such that the adhesive layer is substantially contiguous with the substrate, as shown in FIG. 1. A cold seal package 10 includes a second substrate 18, also referred herein to as a "transfer substrate," in the form of a sheet material. Coated thereon is a second substantially natural latex rubber-free contact adhesive 16 (also referred to herein as "transfer coating contact adhesive"). The second substantially natural latex rubber-free contact adhesive 16 can be coated in any desired pattern on the transfer substrate. The layer of contact adhesive 16 is coated on a layer of a release coating 19 in a substantially contiguous manner on the substrate 18. Alternatively, the anchor coating contact adhesive can be pattern coated on the anchor substrate in the same pattern as is the release coating on the transfer substrate with the transfer coating contact adhesive coated over the entire surface of the substrate.

When brought together, the adhesive coated surfaces of the anchor substrate and the transfer substrate form the cold seal of a package. That is, the interfaced areas of the two substrates (or two portions of one substrate) that are respectively coated with the adhesive or adhesives are typically adhesively connected. These surfaces form the inner walls of a cold seal package. Preferably, the space within a cold seal package that does not correspond to the contact area between first and the second substantially natural latex rubber-free contact adhesives is the space available for placement of an article in a cold seal package. Thus, typically only one of the layers of contact adhesive can be coated on substantially the entire surface of one of the substrates with the other being a peripheral coating on the other substrate, for example, although both layers of adhesive can be pattern coated at the periphery of the two substrates. For example, as shown in FIG. 1, the first substantially natural latex rubber-free contact adhesive 14 is coated substantially over the entire surface of the first substrate 12, while the second substantially natural latex rubber-free contact adhesive 16 is coated as a peripheral coating on the second substrate 18. Accordingly, the article to be sealed within a cold seal package resides within the area 15 outlined by the contact adhesive 16.

The substrate or substrates (e.g., first substrate 12 and second substrate 18 of FIG. 1) are each preferably in the form of a sheet material (e.g., a film), although the substrate (s) can be in other forms. For example, a substrate can be molded to form a sheet of connected but individual compartments that, when sealed, can be used as blister packs for individually packaging tablet- or pill-forms of pharmaceuticals and/or nutraceuticals, batteries, and the like. The preferred sheet material can be made of a polymeric, a woven, or a nonwoven material. Materials used to form the sheet are preferably selected from the group of polyolefins such as polyethylene (including high density, low density, linear low density, metallocene catalyzed polyethylene, etc.) and polypropylene, as well as poly(vinyl acetate), poly (vinylalcohol-co-ethylene), polyvinyl chloride, polyester, poly(ethyl acrylate), ethylene/acrylic acid copolymer (such as that commercially available under the trade designations NUCREL from E.I. du Pont de Nemours, Wilmington, Del., and PRIMACOR from Dow Chemical Co., Midland, Mich.), ethylene/methacrylic acid copolymer, ethylene/vinyl acetate copolymer (such as that commercially available under the trade designation NA 443-021 from Quantum Chemical Co., Cincinnati, Ohio), polychlorotrifluoroethylene, polycarbonate, polytetrafluoroethylene (such as that commercially available under the trade designation of TEFLON from E.I. du Pont de Nemours, Wilmington, Del.), polystyrene, polyacrylonitrile, ionomers of ethylene/methacrylic acid copolymers (such as that commercially available under the trade designation SURLYN from E.I. Du Pont de Nemours, Wilmington, Del.), polyamide, poly(vinylidene chloride), paper, and laminates or composites thereof. A particularly preferred material is high density polyethylene (HDPE) because it is typically stable under sterilization conditions, such as gamma radiation, under highly humid conditions, and it is of lower cost than many other suitable materials. A coextruded laminate of HDPE and a metallocene-catalyzed polyethylene layer is desirable because a backside coating of an anti-blocking composition is typically not required when storing a roll of such a substrate with a contact adhesive coated thereon. When two substrates are used, the two substrates can be of different or of the same materials.

The transfer substrate 18 (FIG. 1) includes at least one major surface that has been coated with a release coating 19. The major modified surface of the substrate is the surface having the substantially natural latex rubber-free contact adhesive 16 thereon. The release coating 19 is preferably substantially continuous regardless of the surface area of the substrate coated. This means that there are preferably substantially no voids or fibrils in the coating. This does not mean that the substrate has to be continuously coated over its entire surface with the release coating. Thus, preferably, the substantially continuous release coating is pattern coated on the substrate 18. Typically, the release coating 19 and the transfer contact adhesive 16 are coated in the same patterns and substantially contiguous with each other; however, the transfer contact adhesive 16 can be coated over the entire transfer surface 18.

The release coating 19 (FIG. 1) includes a polymeric material or mixture of materials with release properties. Preferably, the release material is selected from the group of an ethyl acrylate-acrylonitrile copolymer, an acrylic acid-alkyl acrylate copolymer (e.g., acrylic acid-ethyl acrylate copolymer), a polyvinyl chloride resin, a polyvinyl N-octadecyl carbamate, a polyethylene based wax, a polyamide based wax, a polysiloxane, a fluorocarbon polymer, a polyvinyl ester (e.g., vinyl stearate, vinyl palmitate, etc.), a polyethylene imine, an alkyl substituted amine, a fatty acid based wax (e.g., a fatty acid condensate), a chromium complex (e.g., stearato chromic chloride), and mixtures thereof. Examples of such release coating compositions include those commercially available under the trade designations MICROMID 321RC (a polyamide dispersion) from Union Camp Corp., Jacksonville, Fla., FC270 (a fluorochemical) from Minnesota Mining & Manufacturing Co., St. Paul, Minn., and NORPEL 7645 (a fatty acid condensate) from Northern Products, Inc. Woonsocket, R.I. A particularly preferred release coating is formed from an aqueous polyamide dispersion.

The release coating can be coated out of a composition comprising an aqueous dispersion or solution or an organic solvent dispersion or solution. Alternatively, the release coating can be hot melt coated or coated from a 100% solids composition. For ease and environmental concerns, coating the release coating out of water (typically, distilled or deionized water) is preferred. For those release materials available in 100% solids form in pellets, prill, or blocks, conventional hot melt coating techniques can be used to apply a release coating on a substrate.

Significantly, the release coating can include a substantially natural latex rubber-free contact adhesive or mixture of adhesives in addition to the release material. This enhances the adhesion of the transfer contact adhesive to the release-coated surfaces. The release material and the contact adhesive are preferably used in a ratio of at least about 2 parts release material to about 1 part contact adhesive, more preferably, at least about 5 parts release material to about 1 part contact adhesive, and most preferably, at least about 10 parts release material to about 1 part contact adhesive. The contact adhesives described below can be used for this purpose. For example, a blend of a polyamide dispersion as the release material and a polyurethane dispersion as the contact adhesive can be combined in a ratio of about 10:1 in water, preferably deionized water, to form a release coating composition.

Optional additives to the release coating composition can include ultraviolet light absorbers, antioxidants, viscosity modifiers, and other additives as are known in the art for release compositions. Furthermore, the transfer substrate can optionally include at least one major surface that has been treated to modify the adhesion of the release coating. This can be accomplished using a number of techniques well known to those of skill in the art depending on the substrate chosen, as discussed below for the anchor substrate.

The anchor substrate 12 (FIG. 1) can include at least one major surface that has been treated to modify the adhesion of the contact adhesive. The major modified surface of the substrate is preferably the surface having the substantially natural latex rubber-free contact adhesive thereon. This major surface can be modified to ensure that the contact adhesive adheres firmly to the substrate. This can be accomplished using a number of techniques well known to those of skill in the art depending on the substrate chosen. Suitable techniques include, for example, chlorinating the substrate, oxidizing the substrate with agents such as chromic acid, steam treating the substrate, treating the substrate with an active gas surface treatment technique, and/or coating the substrate with a primer coating composition (e.g., an alkyl titanate, epoxy-type primer, melamine-formaldehyde, etc.).

Treating the anchor substrate with an active gas treatment technique to enhance adhesion of the contact adhesive to the substrate is preferred. Treating the release substrate with an active gas treatment technique to enhance adhesion of the release coating to the substrate is preferred. Examples of active gas treatment techniques include corona, flame, ozone, and plasma treatment processes. Corona discharge treatment of polymeric films to impart certain surface characteristics, e.g., adhesive properties, generally involves electrostatically treating the surface of the film. Specifically, corona treating involves exposing the material to be treated to a gaseous electrical discharge in which the ionization regions are confined around the active electrodes. The specific type of corona used to modify polymer surfaces is the alternating-current (bipolar) streamer corona, which is characterized by two metallic electrodes at least one of which is covered with a dielectric material. The material to be treated is typically located on the grounded electrode. Suitable corona treatment processes for use in the present invention can be any typical corona treatment process, e.g., nitrogen corona, air corona, oxygen corona, halogen corona, etc. The preferred corona treatment process, however, involves air corona treatment. Methods for standard corona treatment processes are described, for example, in U.S. Pat. No. 3,705,844 (Haas); U.S. Pat. No. 3,546,065 (Ostermeier); U.S. Pat. No. 3,503,859 (Goncarovs et al.); and U.S. Pat. No. 3,754,117 (Walter). Typically, at least about 0.1 Joule/cm$^2$ of energy can be used, although 0.3–1.0 Joule/cm$^2$ is preferred. Corona systems are commercially available from Pillar Technology Ltd. Partnership (Hartland, Wis.). Flame treatment of polymeric films is also well known in the art as a surface modification treatment. Representative flame treatment processes are described in U.S. Pat. No. 2,746,084 (Kreidl); U.S. Pat. No. 2,704,382 (Kreidl); U.S. Pat. No. 2,684,097 (Kritchever); U.S. Pat. No. 2,683,394 (Kritchever); and U.S. Pat. No. 2,632,921 (Kreidl).

Referring to FIG. 1, the first substantially natural latex rubber-free contact adhesive 14 and the second substantially natural latex rubber-free contact adhesive 16 are preferably adhesives that are nonadhering or slightly adhering to the touch at temperatures of about 15° C. to about 50° C. and require moderate pressure (such as that exerted by fingertip pressure) to achieve a cold seal bond. That is, the contact adhesives are considered nonpressure sensitive in that materials lacking chemical similarity with the adhesive do not have significant adhesion to the adhesive; however, the contact adhesives tenaciously adhere to each other or other materials having chemical similarities. Preferably, they have a glass transition temperature of about 15° C. or less and possess sufficient plasticity to bond to themselves or chemically similar materials under pressure alone and sufficient hardness to resist bonding to dissimilar substrates under pressure.

Particularly preferred contact adhesives for use in the present invention have an open time (i.e., the time during which the adhesive characteristics are available for forming a bond upon the application of a pressure or force alone) of at least about 24 hours, and more preferably, at least about 3 weeks, and most preferably, at least about one year, at a temperature of about 50° C. or less. In this way, a substrate, such as a sheet material, can be coated with a contact adhesive and stored for a period of time prior to manufacturing the package.

The first substantially natural latex rubber-free contact adhesive 14 and the second substantially natural latex rubber-free contact adhesive 16 can be different or they can be the same contact adhesive, or mixtures of contact adhesives. Thus, the first substantially natural latex rubber-free contact adhesive 14 and the second substantially natural latex rubber-free contact adhesive 16 may possess the same adhesive characteristics or they may possess different adhesive characteristics. If they are the same adhesive, once a cold seal bond is formed, the two layers of contact adhesive may appear as one layer of adhesive.

Preferred polymeric materials for use in the substantially natural latex rubber-free contact adhesive include, for example, a polymeric material selected from the group of polychloroprene; polyurethane (including aqueous polyurethanes as described in U.S. Pat. No. 4,442,259 (Isgur et al.) and those commercially available under the trade designations WD 4007 and 4008-M from H.B. Fuller Co., St. Paul, Minn., and BR-4620 from Basics Adhesives, Inc., Brooklyn, N.Y.); styrene-isoprene copolymers (including terpolymers, tetrapolymers, etc.), such as the series commercially available under the trade designation KRATON, from Shell Chemical Co., Chicago, Ill.; styrene-butadiene copolymer; polyimide; polyvinyl chloride; nitrocellulose; polyisoprene; acrylonitrile-butadiene-isoprene terpolymer, such as the series commercially available under the trade designation ZEON (1201L, 1022, 1072), from Zeon Chemical, Inc., Louisville, Ky.; butadiene/methacrylonitrile copolymer as described in U.S. Pat. No. 5,145,929 (Ou-Yang); polyethylene vinyl acetate; polyacrylates, including a carboxyl modified acrylic emulsion, such as that commercially available under the trade designation BFG1858, from B.F. Goodrich, Cleveland, Ohio, ethyl acrylate/vinyl acetate/methacrylic acid terpolymers described in U.S. Pat. No. 4,898,787 (Min et al.), and those described in U.S. Pat. No. 5,070,164 (Min et al.); and mixtures thereof. More preferred polymeric materials for use in the substantially natural latex rubber-free contact adhesive are those that have a relatively long open time and are selected from the group of polyurethane, styrene-butadiene, acrylonitrile-butadiene-isoprene terpolymer, polyacrylates, styrene-isoprene copolymer, polyisoprene, and mixtures thereof. A particularly preferred contact adhesive is formed from an aqueous polyurethane dispersion.

The contact adhesive can be coated out of a composition comprising an aqueous dispersion or solution or an organic solvent dispersion or solution. Alternatively, the contact adhesive can be hot melt coated or coated from a 100% solids composition. For ease and environmental concerns, coating the adhesive out of water (typically, distilled or deionized water) is preferred, although it is to be understood that some desirable adhesives can only be coated out of an organic solvent, such as heptane, toluene, isopropyl alcohol, methyl ethyl ketone, and the like. Additionally, for those adhesives available in 100% solids form in pellets, prill, or blocks, conventional hot melt coating techniques can be used to apply a coating of contact adhesive on a substrate.

Preferably, the substantially natural latex rubber-free contact adhesive is applied as a polymeric dispersion in an organic solvent, water (also referred to herein as an aqueous contact adhesive or an aqueous (or water) dispersion of a contact adhesive), or a mixture thereof. The viscosity and percent solids may be adjusted as desired and according to the requirements of the coating process employed in making a cold seal package. Typically, the adhesive compositions include about 20% to about 40% solids. Optional additives to the contact adhesive composition can include ultraviolet light absorbers, antioxidants, viscosity modifiers, and other additives as are known in the art for adhesive compositions. Anti-blocking agents, such as silicas or glass bubbles, may also be added to reduce blocking tendencies.

Preferably, the substantially natural latex rubber-free contact adhesives 14 and 16 (FIG. 1) are coated on the anchor substrate 12 and the transfer substrate 18, respectively, each at a coating weight of about 25 $g/m^2$ to about 0.15 $g/m^2$. More preferably, each of the substantially natural latex rubber-free contact adhesives are coated at a coating weight of about 4.0 $g/m^2$ or less, and even more preferably at a coating weight of about 0.8 $g/m^2$ or less. Advantageously, such a coating weight is about ten-fold lower than a typical coating thickness of a natural latex rubber-containing adhesive, which can typically be about 4.2 $g/m^2$ to about 8 $g/m^2$.

When storing unassembled substrates, it is desirable to coat the substrate surface opposite the surface having the contact adhesive coated thereon with an anti-blocking material to prevent blocking of a roll of the substrates. Suitable anti-blocking materials can be the same or similar materials as those used in the release coating compositions, as described above. Other anti-blocking materials are well known in the art, such as those described in U.S. Pat. No. 3,938,659 (Wardwell), U.S. Pat. No. 4,804,573 (McCarthy et al.), U.S. Pat. No. 4,810,747 (Bornack, Jr., et al.), and U.S. Pat. No. 5,516,865 (Urquiola), and European Patent Publication No. 555830 (Bublitz et al.).

Figure 2:
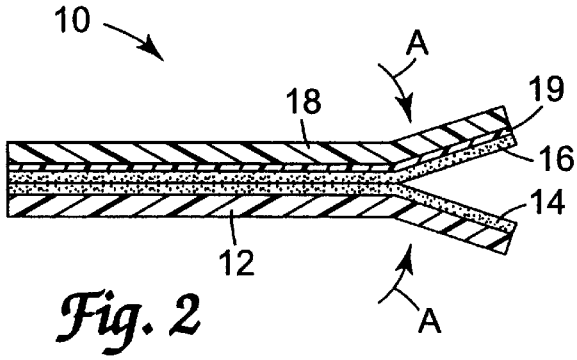
FIG. 2 is a cross-sectional view of a portion of a partially assembled cold seal package in accordance with the invention.
Figure 3:
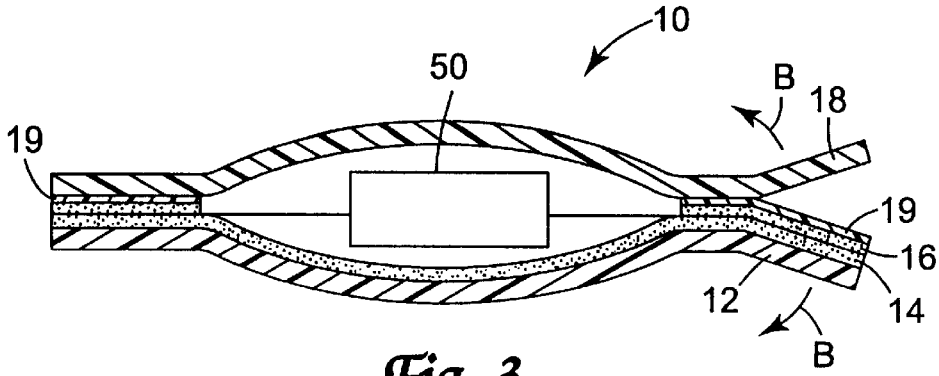
FIG. 3 is a cross-sectional view of a partially opened cold seal package in accordance with the invention showing a product inside of an enclosure.

Referring now to FIG. 2, a partially assembled cold seal package 10 is shown. Pressure is applied to the anchor substrate 12 coated with an anchor coating contact adhesive 14 and the transfer substrate 18 coated with a release coating 19 and transfer coating contact adhesive 16, as shown by arrows A, such that the substantially natural latex rubber-free contact adhesives 14 and 16 contact one another. Preferably, and advantageously, pressure can be applied at room temperature, and even at temperatures within a range of about 15° C. to about 50° C., which simplifies the sealing process because highly heated crimping tools are not required. Once sealed, the substantially natural latex rubber-free contact adhesives 14 and 16 form a substantially continuous adhesive portion between the anchor substrate 12 and the transfer substrate 18. While not wishing to be bound by any particular theory, it is believed that interdiffusion occurs between the substantially natural latex rubber-free contact adhesives 14 and 16 to form a bond. A substantially natural latex rubber-free adhesive bond between a contact adhesive and a release-coated transfer substrate in a cold seal package according to the invention is surprisingly strong, particularly in view of the release coating 19. Advantageously, a cold seal package can be easily opened by peeling apart the first and the second substrates 12 and 18, respectively, as shown in FIG. 3, to release the article 50 (e.g., a medical product) therein. As shown by the arrows B, an opposing force (or peel force) is applied to each of the substrates 12 and 18. The second substantially natural latex rubber-free contact adhesive 16 preferentially adheres to the first substantially natural latex rubber-free contact adhesive 14 on the first substrate 12. This results in a substantially complete transfer of the second substantially natural latex rubber-free contact adhesive 16 from the transfer substrate 18 to the anchor substrate 12 in the area of the seal. There may be other portions of the transfer contact adhesive that were not used in forming the cold seal that remain on the transfer substrate. The release coating 19 may or may not also be transferred with the contact adhesive 16. Typically and preferably, however, at least a portion of the release coating 19 is transferred with the contact adhesive 16 to the anchor substrate 12 upon opening the cold seal of the package 10, as shown in FIG. 3.

Transfer of the transfer coating contact adhesive 16 occurs upon opening a cold seal package of the present invention because adhesion between the anchor coating contact adhesive 14 and the anchor substrate 12 is greater than adhesion between the transfer coating contact adhesive 16 and the release-coated transfer substrate 18. Also, preferably, adhesion between the anchor coating contact adhesive 14 and the transfer coating contact adhesive 16 is greater than adhesion between the transfer coating contact adhesive 16 and the release-coated transfer substrate 18. More preferably, the peel strength between the two contact adhesives 14 and 16 (i.e., the peel strength of the cold seal bond) is greater than about 600 grams/2.5 cm while the peel strength between the contact adhesive 16 and the release-coated transfer substrate 18 is about 600 grams/2.5 cm or less. More preferably, the peel strength between the contact adhesive 16 and the release-coated transfer substrate 18 is about 4 grams/2.5 cm to about 600 grams/2.5 cm, and most preferably, about 100 grams/2.5 cm to about 140 grams/2.5 cm. The level of adhesion between the transfer coating contact adhesive 16 and the release-coated transfer substrate 18 may be a reflection of the level of adhesion at the interfaces between the adhesive and the release coating, between the release coating and the substrate, or both. Thus, the level of adhesion between the contact adhesive and the release-coated transfer substrate does not specifically refer to either of these interfaces.

Because of the relative peel strengths (i.e., differential adhesion), as described above, a cold seal package according to the invention can be opened by peeling apart the first substrate 12 and the second substrate 18, preferably, without breaching the integrity of each of the substrates. That is, a cold seal package according to the invention does not typically require tearing across (i.e., in a direction that is substantially normal to or substantially perpendicular to) the bonded substrates. Thus, a cold seal package of the present invention can be typically opened without showering the package contents with contaminants. Furthermore, a cold seal package according to the invention can be typically opened cleanly such that there is no "stringing" (i.e., there are no segments of adhesive remaining adhered to both substrates and spanning the gap between them).

Figure 4A:
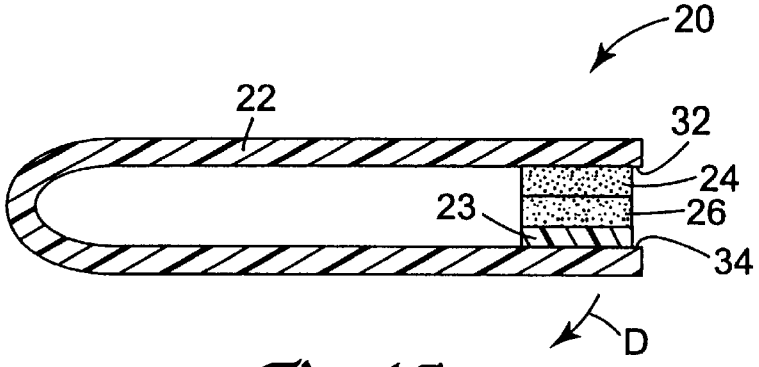
FIGS. 4A and 4B are cross-sectional views of alternative embodiments of assembled cold seal packages in accordance with the invention.
Figure 4B:
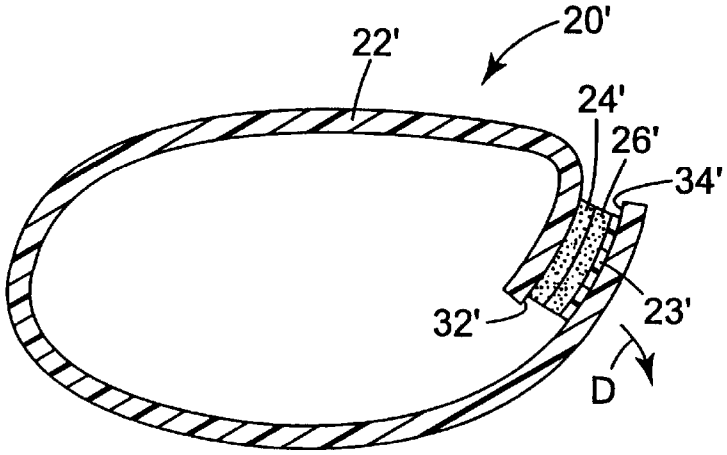

Referring now to FIGS. 4A and 4B, other preferred embodiments of a cold seal package of the present invention are shown, wherein a cold seal package can be formed from a single substrate. In an embodiment shown in FIG. 4A, a cold seal package 20 is formed from a single substrate 22 in the form of a sheet material in which portions of an inner surface of the substrate are adhered together to form a fin-type seal. Alternatively, in an embodiment shown in FIG. 4B, portions of an inner surface and an outer surface of the single substrate 22' are adhered together to form an overlap-type seal.

The single substrate (22 and 22' shown in FIGS. 4A and 4B, respectively) can be formed from any of the materials described above. One portion (34 and 34' in FIGS. 4A and 4B, respectively) is coated with a release coating (23 and 23' in FIGS. 4A and 4B, respectively) analogous to the transfer substrate 18, also as described with reference to FIGS. 1 and 2. Another portion (32 and 32' in FIGS. 4A and 4B, respectively), which is preferably modified to enhance adhesion of the contact adhesive, is analogous to the anchor substrate 12, as described with reference to FIGS. 1 and 2. A first substantially natural latex rubber-free contact adhesive 24 (24' in FIG. 4B) and a second substantially natural latex rubber-free contact adhesive 26 (26' in FIG. 4B) are provided on portions 32 and 34 (32' and 34' in FIG. 4B), respectively. Thus, as described above, relative peel strengths are provided between the inner surface portions 32 (anchor portion) and 34 (transfer portion) shown in FIG. 4A and, similarly, between the inner portion 32' and the outer portion 34' shown in FIG. 4B, such that upon opening the package, the contact adhesives 26 and 26' transfer to the anchor portions 32 and 32'.

In the illustrative embodiments described herein, it is understood that the cold seal between the substrates can be formed utilizing one substantially natural latex rubber-free contact adhesive. That is, the same substantially latex rubber-free contact adhesive may be applied to both a portion of the transfer substrate and a portion of the anchor substrate. Thus, a cold seal can be formed from a single substantially natural latex rubber-free contact adhesive. Alternatively, two different contact adhesives can be used. Because an anchor substrate and a transfer substrate (each as described above) are employed, the cold seal adhesion of the substantially natural latex rubber-free contact adhesive to the anchor substrate is greater than the cold seal adhesion of the substantially natural latex rubber-free contact adhesive and the release-coated transfer substrate. Preferably, the peel strength of the substantially natural latex rubber-free contact adhesive to the anchor substrate is greater than about 600 grams/2.5 cm while the peel strength between the substantially natural latex rubber-free contact adhesive and the release-coated transfer substrate is about 600 grams/2.5 cm or less. More preferably, the peel strength between the substantially natural latex rubber-free contact adhesive and the release-coated transfer substrate is about 4 grams/2.5 cm to about 600 grams/2.5 cm, and most preferably, about 100 grams/2.5 cm to about 140 grams/2.5 cm.

In any embodiment of the present invention, the relative peel strengths are significant when the contents are sterile and aseptic delivery of the contents is not only desired but required. For example, a cold seal package can be simply opened by grasping an outer edge of each of the substrates (as shown in FIG. 3) and peeling apart the substrates. In another example, a cold seal package can be simply opened by grasping one free edge of the substrate and peeling it away from the seal, as shown by arrow D and D', in FIG. 4A and 4B, respectively. Additionally, opening a cold seal package does not typically require tearing the package substrates in the cross-direction. The contents (e.g., article 50 shown in FIG. 3), such as a medical dressing, a bandage, or the like, can be emptied from a cold seal package into a sterile field. Also, because the substantially natural latex rubber-free contact adhesive preferentially adheres to one substrate, it is less likely that the contents will accidentally attach to the package, which could result in contamination of the contents. Once a cold seal package is opened, the two substrates can not readily be resealed upon application of pressure. A non-refastenable seal formed between the two substrates is particularly important in the areas of packaged medical products and comestibles, where evidence of tampering (such as prior opening) is desired. If a cold seal package has been previously opened, the end user will be provided with both visual and tactile indications. Visually, a cold seal package typically appears wrinkled or curled in the areas where prior seals have been opened. Further, even if it could be resealed, a cold seal package typically would tactually exhibit a very small or nonexistent force for reopening.

Additionally, the non-refastenable cold seal and the differential peel strength characteristics of the anchor substrate and the transfer substrate are not affected by the presence of printing or graphics. Printing or graphic indicia can be applied to either the anchor substrate, the transfer substrate, or both prior to the application of the substantially natural latex-rubber free contact adhesive. In one preferred embodiment of the anchor substrate, the substrate material can first be corona treated and the graphic indicia can be applied to the corona treated surface. The anchor coating contact adhesive can then be applied directly over the graphic indicia. In another preferred embodiment, graphic indicia can be applied on the anchor substrate surface opposite the surface to which the anchor coating contact adhesive is applied. In one preferred embodiment of the transfer substrate, the substrate material can first be corona treated and the graphic indicia can be applied to the corona treated surface.

Graphic indicia (e.g., text and corporate identifications) can be printed using processes conventionally used in the graphic arts industry. Such processes include flexo or direct gravure printing, for example. Printing inks are commercially available from a variety of sources such as Sun Chemical (Tokyo, Japan) or Superior Printing Ink Co., Inc. (New York, N.Y.).

Cold seal packages can be made by a variety of conventional coating technologies. For example, the release coating and adhesive coating layers can be coated onto either substrate by conventional coating techniques, such as flood coating, pattern coating, air knife coating, reverse roller coating, flexographic or gravure coating, etc., with pattern coating being preferred. Alternatively, any of the substrates and coatings may be made by extruding, including coextruding techniques. For coatings as thin as those of the present invention, gravure coating techniques can produce coatings with ribbing and air entrainment problems. Ribbing is explained in *Modern Coating and Drying Technology*, E. Cohen and E. Gutoff, VCH Publishers Inc., New York, N.Y., 1992, pages 79–81. It is well known that air entrainment is caused largely by cavitation, which happens at the exit side of the gravure cylinder and back-up roll. By selecting the doctor blade width and stiffness, the angle of the doctor blade to the horizontal, and by applying sufficient pressure to cause the leading edge of the doctor blade to lift from the surface of the gravure cylinder, air entrainment can be controlled sufficiently to produce acceptable coatings. The doctor blade characteristics can be determined emperically as discussed in *Modern Coating and Drying Technology*, at page 105. Ribbing can also be reduced by the choice of cell geometry of the gravure cylinder. In general, it is believed that a relatively low cell density (e.g., about 70 cells/25 mm) and a relatively high cell angle (e.g., about 60°) can produce flatter coatings (i.e., coatings without ribs).

In preferred embodiments, after application of a substantially natural latex rubber-free contact adhesive to a surface of a substrate from a solution or a dispersion, it is preferable that the substantially natural latex rubber-free contact adhesive be dried((typically, in a conventional drying oven) to prevent penetration of the solvent from the adhesive into the substrate. If a release coat is applied to a surface of the substrate from either a solution or a dispersion, it is also preferable that the release composition be dried to prevent penetration of the solvent from the release coating composition into the substrate. More preferably, the release coating composition is dried prior to applying the substantially natural latex rubber-free contact adhesive. Typically, the coating compositions are applied in such a manner as to provide flat, smooth, coatings.

In one method of preparing a cold seal package, a release coating composition is applied to a first major surface of a transfer substrate and dried to form a release coat on the first major surface of the transfer substrate. A first substantially natural latex rubber-free contact adhesive is then applied to the release coat and dried. A second substantially natural latex rubber-free contact adhesive is applied to a first surface of an anchor substrate and dried. Preferably, a pattern of the second substantially natural latex rubber-free contact adhesive is applied to a first surface of an anchor substrate. More preferably, the second substantially natural latex rubber-free contact adhesive is applied to a peripheral portion of the first surface of the anchor substrate.

A sealed cold seal package is formed by applying pressure to the coated transfer substrate and the coated anchor substrate, wherein the first substantially natural latex rubber-free contact adhesive and the second substantially natural latex rubber-free contact adhesive contact one another at a temperature of no greater than about 50° C. A cold seal adhesive bond may be formed by application of sufficient pressure for a sufficient period of time while the two layers of contact adhesive are in contact with each other to achieve the desired cold seal. The period of time required to achieve a cold seal bond (i.e., the bond between the two layers of contact adhesive) is about 1 second or less. The cold seal pressure (i.e., application of pressure at a temperature of about 50° C. or less) typically ranges from about $1.3\times10^5$ Pascals to about $6.9\times10^5$ Pascals, preferably about $5.5\times10^5$ Pascals.

EXAMPLES

The following examples are offered to aid in understanding of the present invention and are not to be construed as limiting the scope thereof. Unless otherwise indicated, all parts and percentages are by weight.

Example 1

This example describes the construction and opening characteristics of a package prepared with polyurethane-based cold seal contact adhesives coated on paper and film substrates with the paper substrate additionally having a release coating layer.

A transfer substrate made of 16-kg medical grade paper (Wausau Mills, Rhinelander, Wis.) was coated with a release coating composition containing a 15% solids aqueous polyamide dispersion, MICROMID 321RC (Union Camp Corp.) using a knife bar coater at a 10-micron orifice setting. The release coating composition was immediately dried at approximately 120° C. for several seconds to remove the water. A transfer coating contact adhesive containing a 35% solids aqueous polyurethane dispersion, WD4007 (H.B. Fuller Co., St. Paul, Minn.), was overcoated at approximately 50 microns in a rectangular pattern with a paint brush, and immediately dried at approximately 120° C. for several seconds to prevent water penetration into the paper.

An anchor substrate made of 50-micron thick, corona-treated, high density polyethylene (HDPE) film (Huntsman Performance Films, S. Deerfield, Mass., corona treated on one surface in air to about 44–48 dynes/cm surface tension) was coated on the corona-treated surface with an anchor coating contact adhesive containing a 35% solids aqueous polyurethane dispersion, WD4008-M (H. B. Fuller Co.) using a knife bar coater with an orifice setting of 12 microns. The anchor coating contact adhesive was dried at 80° C. for five minutes to give a coating thickness of approximately 6.3 microns.

A sealed package was formed by passing the two coated substrates through nip rollers at a setting of 17.8 Newtons/cm with the coatings overlapping to activate a cohesive bond between the two contact adhesives. The package could be easily opened without tearing or destroying the substrates by grasping the edge of each substrate and peeling them apart causing the rectangular-shaped transfer coating adhesive to remain bonded to, and transfer to, the adhesive-coated anchor substrate. The opened package could not be resealed by pressing the two substrates back together.

Example 2

The force required to peel a coating of contact adhesive from a release-coated substrate (T-Peel Force) was measured for several cold sealed packages in this example.

The release coating layers listed in Table 1 were coated with a #4 wire wound bar onto transfer substrates made of corona-treated, HDPE film (Huntsman Performance Films, corona treated on one surface in air to about 44–48 dynes/cm surface tension) and dried. The release coating layers were coated on the corona-treated surface of the HDPE film. A 35% solids aqueous polyurethane dispersion, WD4007 (H.B. Fuller Co.), was bar coated onto the corona-treated surface of the HDPE film at a coating weight of approximately 8.4 g/m$^2$ and dried. An anchor substrate made of HDPE film (Huntsman Performance Films, corona treated on one surface in air to about 44–48 dynes/cm surface tension) was bar coated with a 35% solids aqueous polyurethane dispersion, WD4008-M (H.B. Fuller Co.), at a coating weight of approximately 4.2 g/m$^2$ and dried. Sealed packages (Samples 2A, 2B, and 2C) were formed by passing a coated transfer substrate paired with the coated anchor substrate through nip rollers as described in Example 1. The T-Peel Forces were then measured utilizing ASTM D1876 (1996) at a separation rate setting of 30.5 cm/minute. Results are provided in Table 1.

TABLE 1

T-Peel Force for Various Cold Sealed Packages

| Sample | Release Layer Coating | T-Peel force (g/25 mm) |
|---|---|---|
| 2A | MICROMID 321RC polyamide | 90 |
| 2B | NORPEL 7645 fatty acid condensate (Northern Products, Inc., Woonsocket, RI) | 220 |
| 2C | FC270 (3M Co., St. Paul, MN) | 110 |

For all samples, the package could be easily peeled open without tearing or destroying the substrates. The transfer adhesive coating transferred cleanly to the anchor substrate. Reattachment of the substrate films was not possible by the use of finger pressure.

Example 3

A transfer substrate made of 50-micron, corona-treated, HDPE film (Huntsman Performance Films, corona treated on one surface in air to about 44–48 dynes/cm surface tension) was coated with a release coating composition of a 10% solids aqueous polyamide dispersion, MICROMID 321RC (Union Camp Corp.), using a #4 wire wound bar and dried immediately with a hot air stream from a heat gun. The release coating composition was coated on the corona-treated surface of the HDPE film. A transfer coating contact adhesive of a 35% solids aqueous polyurethane dispersion, WD4008-M (H.B. Fuller), was overcoated on the release layer using a #4 wire wound bar and immediately dried with a heat gun.

An anchor substrate made of 50-micron, corona-treated, HDPE film (Hunstman Packaging Corp., corona treated on one surface in air to about 44–48 dynes/cm surface tension) was bar coated with an anchor coating contact adhesive of a 35% solids aqueous polyurethane dispersion, WD4007 (H.B. Fuller), at a thickness of approximately 18 microns. The dispersion was dried immediately with a heat gun, to yield a coating weight of approximately 3.2 g/m$^2$ on the corona-treated surface of the HDPE film.

A sealed package was formed as described in Example 1. The package could be easily peeled open without tearing or destroying either the transfer substrate or the anchor substrate. The transfer contact adhesive layer transferred cleanly to the anchor contact adhesive layer. The T-Peel force of the transfer contact adhesive to the release-coated transfer substrate was measured as described in Example 2 and found to be 150 g/25 mm. Reattachment of the substrate films was not possible by the use of finger pressure.

Example 4

This example describes the construction of a two piece package consisting of two substrates coated such that a sealed enclosure is created by bringing the two films together and by applying normal finger type pressure.

A first substrate, a transfer substrate having a release coating and a transfer contact adhesive coating thereon, was constructed from a 62.5-micron thick, white, corona-treated, HDPE film (Huntsman Performance Films, S. Deerfield, Mass., 990 grade, corona treated on one surface in air to about 44–48 dynes/cm surface tension). An aqueous polyamide dispersion, MICROMID 321-RC (Union Camp Corp.), was diluted to 10% solids with distilled water and coated on the corona treated side of the film using a #4 wire wound coating rod. The dispersion was immediately dried in a standard laboratory oven at 150° F. (66° C.) for 15 minutes to form a release coating. An aqueous polyurethane dispersion, WD-4008-M (H.B. Fuller Co.), was diluted to 20% solids with distilled water and coated over the MICROMID polyamide layer using a #4 wire wound coating rod. The dispersion was immediately dried in a standard laboratory oven at 150° F. (66° C.) for 15 minutes.

A second substrate, an anchor substrate having an anchor contact adhesive coating thereon, was constructed from a 50-micron thick, clear, corona-treated, HDPE film (Huntsman Performance Films, S. Deerfield, Mass., 990 grade, corona treated on one surface in air to about 44–48 dynes/cm surface tension). A 35% solids aqueous polyurethane dispersion, WD-4007 (H.B. Fuller Co.), was coated on the corona-treated side of the clear HDPE film using a #4 wire wound coating rod. The dispersion was immediately dried in a standard laboratory oven at 150° F. (66° C.) for 15 minutes.

These two substrates were then laminated together with the adhesive surfaces together to form a package as described in Example 1. The package could be easily peeled open without tearing or destroying either the transfer substrate or the anchor substrate. The adhesive coating on the transfer substrate was cleanly transferred to the anchor substrate.

Example 5

This example describes the construction of a two piece package as in Example 4 with the release coating modified with a contact adhesive.

A first substrate, a transfer substrate having a release coating and a transfer contact adhesive coating thereon, was constructed from a 62.5-micron thick, white, HDPE film (Huntsman Performance Films, S. Deerfield, Mass., 990 grade, corona treated on one surface in air to about 44–48 dynes/cm surface tension). An aqueous blend of a polyamide dispersion, MICROMID 321-RC (Union Camp Corp.), and a polyurethane dispersion, WD-4007 (H.B. Fuller Co.), was coated on the corona-treated side of the film using a #4 wire wound coating rod. The blend of the MICROMID 321-RC polyamide and WD-4007 polyurethane consisted of 10 parts MICROMID 321-RC, 1.2 parts WD-4007, and 23 parts distilled water. The blend was immediately dried in a standard laboratory oven at 150° F. (66° C.) for 15 minutes to form a release coating. An aqueous polyurethane dispersion, WD-4008-M (H.B. Fuller Co.), was diluted to 20% solids with distilled water and coated over the MICROMID/WD-4007 blend coating using a #4 wire wound coating rod. The dispersion was immediately dried in a standard laboratory oven at 150° F. (66° C.) for 15 minutes.

This substrate was laminated to the anchor substrate of Example 4 with the adhesive surfaces together to form a package as described in Example 1. The package could be easily peeled open without tearing or destroying either the transfer substrate or the anchor substrate. The adhesive coating on the transfer substrate was cleanly transferred to the anchor substrate.

Example 6

This example describes the construction of a gravure printed anchor substrate. A 50-micron thick, clear, corona-treated, HDPE film (Huntsman Performance Films, S. Deerfield, Mass., 990 grade, corona treated on one surface in air to about 44–48 dynes/cm surface tension) was coated with a 35% solids aqueous polyurethane dispersion, WD-4007 (H.B. Fuller Co.) in a frame-style pattern. The frame-style coating pattern was accomplished using a conventional forward direct gravure coating station such as those illustrated in H. Weiss, *Rotogravure and Flexographic Printing Presses*, page 165, Converting Technology Corp. (Milwaukee, Wis.), 1985. The gravure cylinder was engraved with a frame style pattern with the following cell geometry: 70 cells/25 mm, cut with a 120° stylus angle and a 60° cell angle, and cut to 90% of full depth. There were no connecting channels between the cells. The engraver was made by Ohio Electronic Engraving, Dayton, Ohio. After engraving the cylinder, it was plated with 4 microns of chrome and cross polished to an RZ (normalized radius of roughness in the Z direction) of 0.5 micron. The gravure station was equipped with a doctor blade (250 micron by 37.5 mm).

Figure 5:
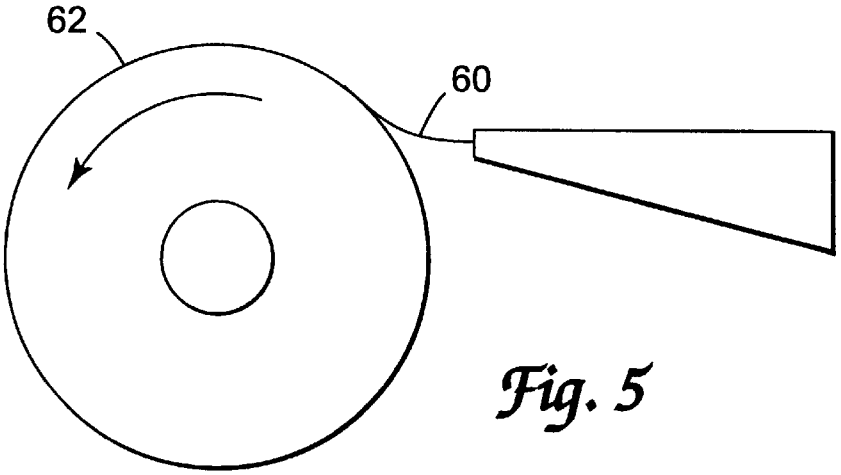
FIG. 5 is a representation of a preferred orientation of a gravure cylinder and a doctor blade.

As shown in FIG. 5, the doctor blade 60 was positioned to contact the gravure cylinder 62 at about the 1:00 position and at an angle of 12° from the horizontal. Sufficient pressure was then applied to bend the doctor blade until the leading edge of the blade lifted from the surface of the gravure cylinder by no more than 76 microns to allow the gravure cylinder to be wiped by the side of the blade rather than the leading edge of the blade. If this distance increased beyond 76 micron, ribbing of fluid started to form on the surface of gravure cylinder. When this occurred, the pressure applied to the doctor blade was then reduced until the ribbing of the fluid on the gravure cylinder disappeared. In this way, bubbles of air entrainment within the coating can be controlled. The dispersion was immediately dried in a conventional direct fired air flow oven at approximately 80° C. to produce an average coating weight in the coated areas of 4.2 $g/m^2$. The dried coating was substantially bubble free and showed minimal ribbing (i.e., undulations) after laminating to a flood coated transfer substrate.

All patents, patent documents, and publications cited herein are incorporated by reference as if each were individually incorporated by reference. Various modifications and alterations of this invention will be apparent to those skilled in the art without departing from the scope and spirit of this invention, and it should be understood that this invention is not limited to the illustrative embodiments set forth herein.

What is claimed is:

1. A method for making a cold seal package comprising:

applying a first substantially natural latex rubber-free contact adhesive to an anchor surface to form an anchor contact adhesive coating;

applying a release coating composition to a transfer surface to form a release-coated transfer surface;

applying a second substantially natural latex rubber-free contact adhesive to the release-coated transfer surface to form a transfer contact adhesive coating; and contacting the anchor contact adhesive coating with the transfer contact adhesive coating, each of which are at a temperature of about 50° C. or less, to form a substantially non-refastenable cold seal between the anchor surface and the release-coated transfer surface; wherein, upon peeling the anchor and transfer surfaces apart, substantially all of the anchor contact adhesive coating and the transfer contact adhesive coating that formed the cold seal remain on the anchor surface;

wherein the release coating composition comprises a release material blended with a substantially natural latex rubber-free contact adhesive.

2. The method of claim 1 wherein the first substantially natural latex rubber-free contact adhesive and the second substantially natural latex rubber-free contact adhesive comprise the same contact adhesive.

3. The method of claim 1 wherein the first substantially natural latex rubber-free contact adhesive and the second substantially natural latex rubber-free contact adhesive comprise different contact adhesives.

4. The method of claim 1 further comprising treating the anchor surface prior to applying the first substantially natural latex rubber-free contact adhesive.

5. The method of claim 4 wherein treating the anchor surface comprises corona treating the anchor surface.

6. The method of claim 1 wherein applying a release coating composition comprises applying a release coating composition to a transfer surface to form a substantially continuous release coating on the release-coated transfer surface.

7. The method of claim 6 wherein the substantially continuous release coating composition is pattern coated on the transfer surface.

8. The method of claim 1 wherein the first and second substantially natural latex rubber-free contact adhesives have an open time of at least about 24 hours at a temperature of about 50° C. or less.

9. The method of claim 1 wherein the anchor surface and the transfer surface are on two separate substrates.

10. The method of claim 9 wherein each substrate comprises a polymeric film.

11. The method of claim 10 wherein the polymeric film comprises a high density polyethylene.

12. The method of claim 1 wherein the anchor surface and the transfer surface are on two different portions of a contiguous sheet material.

13. The method of claim 12 wherein the anchor surface and the transfer surface are each on a different portion of a first major surface of the sheet material.

14. The method of claim 12 wherein the anchor surface is on a portion of a first major surface of the sheet material and the transfer surface is on a second major surface of the sheet material.

15. The method of claim 1 wherein the anchor surface and the transfer surface each comprise a first major surface of separate sheet materials.

16. The method of claim 15 further comprising printing graphic indicia on at least one of the separate sheet materials.

17. The method of claim 1 wherein contacting the adhesive coatings to form a substantially non-refastenable cold seal produces an enclosure within the package.

18. The method of claim 17 further comprising placing a medical product in the enclosure before sealing the package and sterilizing the medical product after sealing the package.

19. The method of claim 1 wherein the release coating composition comprises a release material selected from the group of an ethyl acrylate-acrylonitrile copolymer, an acrylic acid-alkyl acrylate copolymer, a polyvinyl chloride resin, a polyvinyl N-octadecyl carbamate, a polyethylene based wax, a polyamide based wax, a polysiloxane, a fluorocarbon polymer, a polyvinyl ester, a polyethylene imine, an alkyl substituted amine, a chromium complex, a fatty acid based wax, and mixtures thereof.

20. The method of claim 1 wherein the first and second substantially natural latex rubber-free contact adhesives each comprise a material selected from the group of a polychloroprene, a polyurethane, a styrene-isoprene copolymer, a styrene-butadiene copolymer, a polyimide, a polyvinyl chloride, a nitrocellulose, a polyisoprene, an acrylonitrile-butadiene-isoprene terpolymer, a butadiene-methacrylonitrile copolymer, a polyethylene-vinyl acetate copolymer, a polyacrylate, and mixtures thereof.

21. The method of claim 20 wherein at least one of the first and second substantially natural latex rubber-free contact adhesives is formed from an aqueous polyurethane dispersion.

22. A cold seal package produced by the method of claim 1.

23. A method for making a cold seal package comprising:

applying a first substantially natural latex rubber-free contact adhesive to an anchor surface to form an anchor contact adhesive coating;

applying a release coating composition to a transfer surface to form a substantially continuous pattern-coated release coating thereon thereby forming a release-coated transfer surface;

applying a second substantially natural latex rubber-free contact adhesive to the release-coated transfer surface to form a transfer contact adhesive coating; and contacting the anchor contact adhesive coating with the transfer contact adhesive coating, each of which are at a temperature of about 50° C. or less, to form a substantially non-refastenable cold seal between the anchor surface and the release-coated transfer surface; wherein, upon peeling the anchor and transfer surfaces apart, substantially all of the anchor contact adhesive coating and the transfer contact adhesive coating that formed the cold seal remain on the anchor surface.

24. A cold seal package produced by the method of claim 23.

25. A method for making a cold seal package comprising:

applying a first substantially natural latex rubber-free contact adhesive to an anchor surface to form an anchor contact adhesive coating;

applying a release coating composition to a transfer surface to form a release-coated transfer surface wherein the anchor surface and the transfer surface are on two different portions of a contiguous sheet material;

applying a second substantially natural latex rubber-free contact adhesive to the release-coated transfer surface to form a transfer contact adhesive coating; and contacting the anchor contact adhesive coating with the transfer contact adhesive coating, each of which are at a temperature of about 50° C. or less, to form a substantially non-refastenable cold seal between the anchor surface and the release-coated transfer surface; wherein, upon peeling the anchor and transfer surfaces apart, substantially all of the anchor contact adhesive coating and the transfer contact adhesive coating that formed the cold seal remain on the anchor surface.

26. A cold seal package produced by the method of claim 25.

27. A method for making a cold seal package comprising:

applying a first substantially natural latex rubber-free contact adhesive to an anchor surface to form an anchor contact adhesive coating, wherein the anchor surface is part of a substrate comprising a high density polyethylene polymeric film;

applying a release coating composition to a transfer surface to form a release-coated transfer surface, wherein the transfer surface is part of a substrate comprising a high density polyethylene polymeric film;

applying a second substantially natural latex rubber-free contact adhesive to the release-coated transfer surface to form a transfer contact adhesive coating; and contacting the anchor contact adhesive coating with the transfer contact adhesive coating, each of which are at a temperature of about 50° C. or less, to form a substantially non-refastenable cold seal between the anchor surface and the release-coated transfer surface; wherein, upon peeling the anchor and transfer surfaces apart, substantially all of the anchor contact adhesive coating and the transfer contact adhesive coating that formed the cold seal remain on the anchor surface.

28. A cold seal package produced by the method of claim 27.

* * * * *